US005123856A

United States Patent [19]

Brinkmann

[11] Patent Number: 5,123,856

[45] Date of Patent: Jun. 23, 1992

[54] ELECTRICAL PLUG CONNECTOR, ESPECIALLY FOR SENSORS

[75] Inventor: Heinz-Jurgen Brinkmann, Schlieren, Switzerland

[73] Assignee: Ingold Messtechnik AG, Urdorf, Switzerland

[21] Appl. No.: 668,029

[22] Filed: Mar. 12, 1991

[30] Foreign Application Priority Data

Mar. 13, 1990 [CH] Switzerland ..... 00805/90

[51] Int. Cl.[5] ..... H01R 13/28; H01R 25/00

[52] U.S. Cl. ..... 439/289

[58] Field of Search ..... 439/287, 289, 292, 293, 439/607

[56] References Cited

U.S. PATENT DOCUMENTS

| | | | |
|---|---|---|---|
| 4,060,298 | 11/1977 | Gearin | 439/289 |
| 4,167,300 | 9/1979 | Fischer et al. | 339/94 C |
| 4,772,217 | 9/1988 | Petersen | 439/278 |
| 4,853,725 | 8/1989 | Matsuda et al. | 354/286 |
| 4,894,495 | 1/1990 | Toda | 200/51.12 |
| 4,934,954 | 6/1990 | Fransson et al. | 439/289 |

FOREIGN PATENT DOCUMENTS

| | | | |
|---|---|---|---|
| 297961 | 1/1989 | European Pat. Off. . | |
| 1008377 | 5/1957 | Fed. Rep. of Germany . | |
| 7128044 | 7/1971 | Fed. Rep. of Germany . | |
| 2301798 | 7/1974 | Fed. Rep. of Germany . | |
| 7720922 | 11/1977 | Fed. Rep. of Germany . | |
| 3708131 | 9/1987 | Fed. Rep. of Germany . | |
| 8904676 | 5/1990 | Fed. Rep. of Germany . | |
| 9005156 | 7/1990 | Fed. Rep. of Germany . | |
| 3910514 | 10/1990 | Fed. Rep. of Germany . | |
| 2007037 | 5/1979 | United Kingdom | 439/289 |
| 2199668 | 7/1988 | United Kingdom . | |

*Primary Examiner*—Paula A. Bradley
*Attorney, Agent, or Firm*—Sandler, Greenblum, & Bernstein

[57] ABSTRACT

Each connector part is provided with an electrically insulating body member and at least two pole contacts. A shield surrounds each associated electrically insulating body member. A position-fixation device serves to positionally retain the connector parts when intercoupled with one another. To impart to each connector part as smooth as possible and niche-free surface there is provided at the end face thereof one or more contact pieces, depending upon the number of pole contacts or poles contemplated for such connector part. Each contact piece is situated at least approximately in the plane of the end face of the associated connector part. Each such contact piece flushly bears against an associated contact piece of the other connector part when the connector parts are intercoupled with one another, and the contact pieces of one connector part are resiliently pre-biased in their contact-making direction. The electrical connector is relatively maintenance-free, prevents the accumulation of dirt and moisture and thus is exceedingly functionally reliable.

7 Claims, 2 Drawing Sheets

ELECTRICAL PLUG CONNECTOR, ESPECIALLY FOR SENSORS

BACKGROUND OF THE INVENTION

1. Field of the Invention

The present invention relates to a new and improved electrical connector or electrical plug connector, especially for sensors.

More specifically, the electrical connector, especially for sensors, as contemplated by the present development, is of the type comprising a first connector part and a second connector part, each of the connector parts possessing at least two pole contacts or poles within a related electrically insulating body member. A shield or screen encircles each electrically insulating body member and there is also provided a position fixation or securing means for the connector parts when coupled together.

2. Discussion of the Background and Material Information

Electrical connectors of the previously mentioned type are known in different constructions. These electrical connectors are designed in accordance with the male-female principle of the connector parts or components. By virtue of such construction there are necessarily formed recesses or hollow spaces or cavities either at the side of the male connector part, the plug, or the female connector part, the socket or receptacle. Frequently, such electrical connectors are fixedly mounted at sensors, for example, temperature sensors or feelers, pH-electrodes and the like. Some of these sensors, such as, for instance, pH-electrodes constitute high-ohm signal sources. Thus, extremely high requirements are placed upon the electrical insulation for the electrical connector. With prior art electrical connectors, when they are disconnected or de-coupled, water or moisture can penetrate into the recesses or hollow spaces or the like and drastically impair the insulation resistance, the sensor then becoming non-functional. Cleaning or drying of the electrical contacts of such electrical connectors is exceedingly difficult due to the nature or construction of the aforementioned recesses or hollow spaces or the like. As a consequence thereof, during the maintenance of these sensors, for instance, during the exchange thereof in rugged environments there can arise spurious signals.

SUMMARY OF THE INVENTION

Therefore, with the foregoing in mind, it is a primary object of the present invention to provide an improved electrical connector or electrical plug connector of the previously mentioned type which avoids or at least appreciably minimizes the aforementioned drawbacks and limitations of the prior art.

Another and more specific object of the present invention is concerned with providing an improved electrical connector, especially for sensors, which is not readily prone to contamination or soiling, is extremely reliable in operation and of relatively simple construction and design.

Now in order to implement these and still further objects of the present invention, which will become more readily apparent as the description proceeds, the electrical connector of the present development is manifested, among other things, by the features that each connector part possesses for each pole a contact piece, the contact pieces of one connector part being resiliently arranged in a contact-making direction of such contact pieces of the one connector part, and the contact pieces of the other connector part being disposed at least approximately in the plane of an end face or surface of such other connector part.

By virtue of the fact that at the end face or surface of each connector part a contact piece is present for each pole or terminal, and that operatively correlated contact pieces, in the intercoupled state of the connector parts of the electrical connector, flushly or snugly abut one another, and moreover, since the contact pieces of one connector part are resiliently arranged in the contact-making direction, there are advantageously realized electrical connectors possessing essentially planar or flat surfaces and there are avoided recesses and hollow spaces or the like. Such designed electrical connectors make it more difficult for moisture to accumulate, and moreover, can be cleaned and dried in a simple manner. Such electrical connector is not only suitable for double-pole lines or conductors, rather especially also for multi-pole lines or conductors. Due to the stationary construction of the contact pieces or elements of one of the connector parts, the contact element is arranged or embedded securely in an insulating body so that even the smallest pockets are avoided which would favor the accumulation of dirt and moisture. Further, the pivotal coupling of the connector parts by means of a bayonet fixing means enables an automatic cleaning of the contact surfaces and ensures a safe, disturbance-free signal transmission. This is further aided by the projecting shielding of one of the connector parts, such that during the coupling of the connector parts, the shielding comes into contact before the contact elements are engaged, thereby ensuring a disturbance-free environment for the signal transmission.

Regarding the construction of the contact pieces or elements there are available the most different possibilities. Thus, the electrical connector can be constructed such that each contact piece of one connector part has an end face which possesses a convex shape and each contact piece of the other connector part has an end face which possesses a substantially planar or flat shape. Hence, convex contact pieces can slide upon planar contact regions when the first and second connector parts are intercoupled with one another.

However, a more advantageous design contemplates that each contact piece of each connector part has an end face which possesses a convex shape. When such connector parts of the electrical connector are assembled together or intercoupled and moved towards one another, then self-cleaning of the convex contact pieces is afforded because of their punctiform contact.

A particularly simple construction of the resilient contact piece or element is realized by embedding each of the resiliently arranged or mounted contact pieces in an elastic material.

According to a further aspect of the invention, each of the resiliently arranged or mounted contact pieces is pre-biased by an associated spring. This renders possible larger spring excursions or travel strokes, and thus, also a positive pre-biasing of mutually touching contact pieces.

A particularly advantageous design of the electrical connector is afforded when one of the connector parts defines a plug or male part and the contact pieces thereof are stationarily arranged, this plug or male part is fixedly arranged at a sensor. Due to the stationary construction of each contact piece at the plug or male part each such contact piece can be positively arranged in the associated electrically insulating body member and, for instance, embedded. In this way, there can be precluded the formation of even the smallest pockets or cavities which could promote the accumulation of moisture or the like.

Concerning the design of the end faces or surfaces of the electrical insulating bodies, the most different possibilities are available. Even so, there is favored a construction wherein these end faces or surfaces of the electrically insulating body members, which confront one another when the first and second connector parts are intercoupled or assembled together, define surfaces which are disposed substantially perpendicular to a so-called plug-in axis, that is, the lengthwise axis of the intercoupled first and second connector parts. With this construction there is realized a particularly planar and recess- or niche-free design of each connector part.

Equally, the most different designs are possible for the shields or screens, but there is preferred a particularly simple layout wherein the contact pieces of the connector part which defines the plug or male part are stationarily arranged, and the shield or screen of this one connector part which surrounds the associated electrically insulating body member extends to a position which is substantially flush with an end face or surface of such electrically insulating body member. The other one of the connector parts then defines a female or socket or receptacle part, and the shield or screen of this other connector part extends beyond an end face or surface of the electrically insulating body member of such other connector part. Not only is such design especially simple, but there are desirably avoided the formation of pockets and niches, and additionally, such electrical connector is easy to clean.

As far as the coupling structure or device for intercoupling or assembling together the first and second connector parts, once again different constructions are possible, such as, for example, threaded fasteners or closures or the like. However, an especially advantageous design contemplates the provision of means for enabling the first and second connector parts, when intercoupled with one another, to pivot from a predetermined plug-in position to a predetermined contact position, and such enabling means comprise bayonet fixing or locking means.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
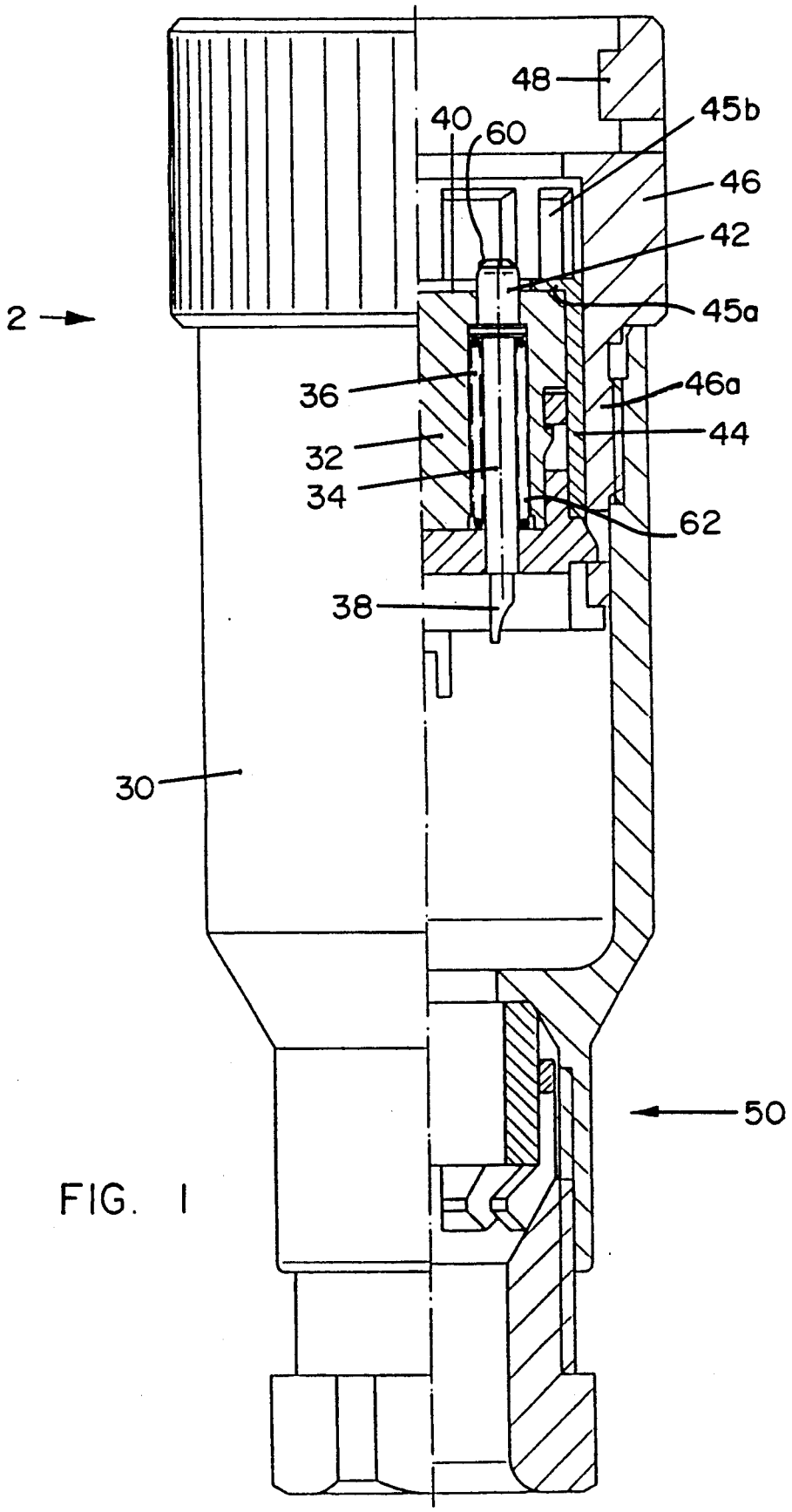
FIG. 1 schematically illustrates one connector part of an electrical connector which constitutes the female or socket or receptacle part, wherein one-half of the illustration is in longitudinal section.
Figure 3:
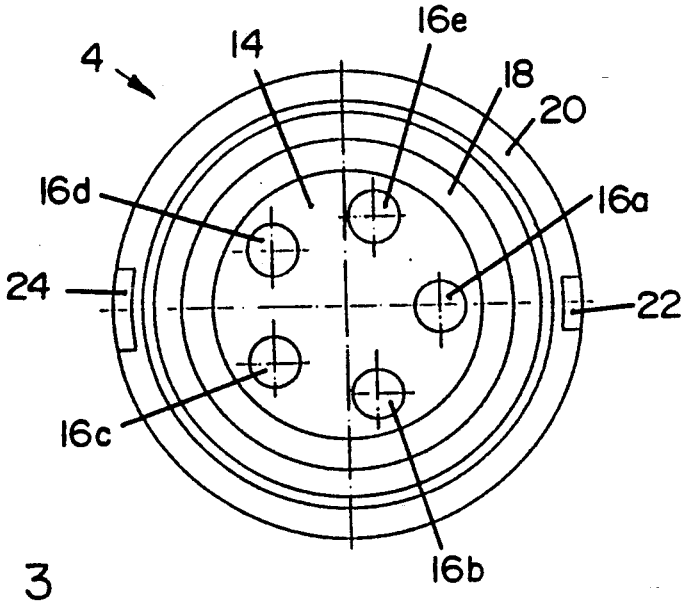
FIG. 3 is an end view looking at an end face or surface of the male connector part depicted in FIG. 2.
Figure 2:
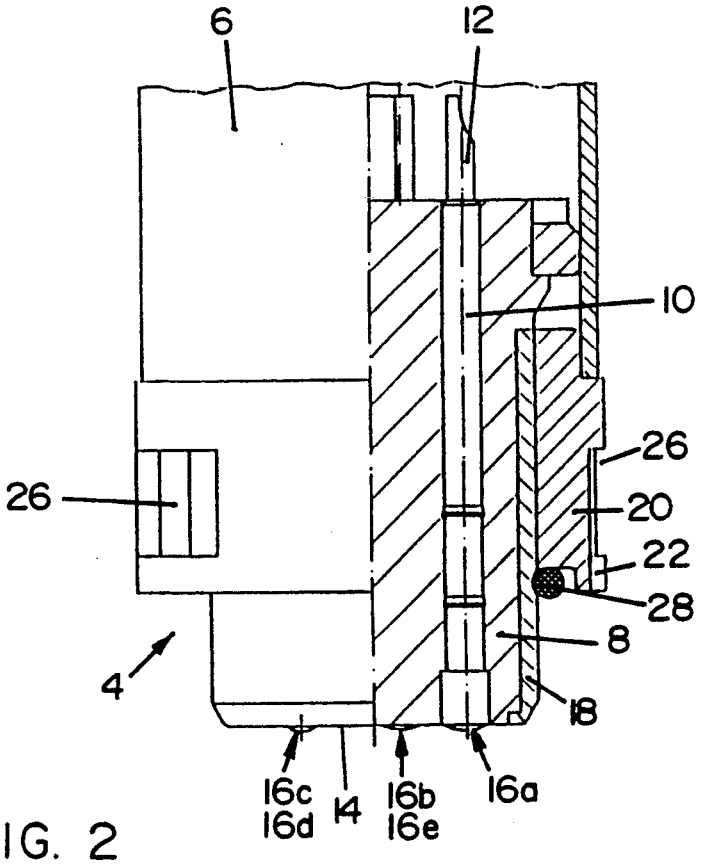
FIG. 2 schematically illustrates the other connector part of the electrical connector which constitutes the male or plug part thereof, and again one-half of the illustration is in longitudinal section.

Describing now the drawings, it is to be understood that only enough of the construction of the exemplary embodiments of electrical connectors or electrical plug connectors have been depicted therein, in order to simplify the illustration, as needed for those skilled in the art to readily understand the underlying principles and concepts of the present invention. In particular, FIGS. 1 to 3 depict an electrical connector wherein the connector part or component 2, shown in FIG. 1, is designed as the female or socket or receptacle which is connected with any suitable and thus here not depicted electrical cable or the like. The connector part or component 4, depicted in FIG. 2, is designed as the male or plug, which is, for instance, fixedly connected or installed at one end thereof at any suitable sensor 6. In the illustrated embodiment, the electrical connector is designed, by way of example, for a five-pole or five-terminal electrical line or conductor.

The male connector part 4 of FIG. 2 contains an electrically insulating body ember 8 in which there are embedded five contact pins or elements 10 which are provided at the inner ends thereof with the solder flags or lugs 12 or any other suitable attachment means for the connection thereto of electrical lines or conductors. The outer ends of these contact pins 10, at the location of a substantially planar or flat end face or surface 14 of the electrically insulating body member 8, form convex contact pieces 16*a*, 16*b*, 16*c*, 16*d* and 16*e*. Consequently, these convex contact pieces 16*a*, 16*b*, 16*c*, 16*d* and 16*e* lie practically in the plane of the end face or surface 14 of the associated connector part 4 and form punctiform contact regions or zones. The electrically insulating body member 8 is encircled or surrounded by a metallic shield or screen 18 which at its outer face or surface likewise flushly terminates at the end face or surface 14 of the connector part 4.

Furthermore, the connector part 4 is provided with an externally situated coupling portion or element 20 of a bayonet coupling or fixation means. This coupling portion or element 20 contains at its outer side a small groove or slot 22 and diametrically opposite thereto a wide groove or slot 24, which render possible engagement therein of appropriate or complementary noses or protuberances 48 or the like provided at the other coupling portion or element, as will be further considered hereinafter in order to precisely define the exact coupling angle of the contact elements being connected together. Additionally, the coupling portion 20 is provided with short, peripherally extending recesses or pockets 26 for the lugs of the other coupling portion which govern pivoting of the connector part 4 designed as the plug or male with the connector part 2 designed as the socket or female and afford a reliable positional-fixation of the assembled connector parts 2 and 4 when intercoupled with one another. Moreover, a sealing ring or gasket 28 serves for the sealing of the interior of the electrical connector when the connector parts 2 and 4 are intercoupled with one another.

FIG. 1 shows in detail the connector part 2 designed as the female or socket or receptacle which contains an electrically insulating body member 32 within a housing or casing 30. Here, for instance, five contact pins or elements 34 are arranged within the electrically insulating body member 32 and which are operatively associated with the five contact pins 10 of the other connector part 4. The five contact pins 34 are displaceably mounted within the electrically insulating body member 32 and are outwardly pre-biased in a contact-making direction, that is, towards the five contact pins 10 of the other connector part 4 when the connector parts 2 and 4 are intercoupled with one another. At the inner side or end of each of the contact pins 34 there is provided a solder flag or lug 38 or other suitable attachment or connection means for the individual electrical phases of the associated electrical cable. Each contact pin 34 slightly protrudes past the end face or surface 40 of the associated electrically insulating body member 32 and forms a contact piece 42 against which rests an associated one of the contact pieces 16*a*, 16*b*, 16*c*, 16*d* and 16*e* of the other connector part 4 in the intercoupled state of the connector parts 2 and 4. The contact pieces 42 may be provided with either substantially planar or flat end faces or surfaces as shown in full lines, or else with convex end faces or surfaces as generally shown with dotted lines indicated by reference numeral 60. Each contact piece 42 and the contact pin 34 thereof are pressed against the electrically insulating body member 32 by the action of an associated resilient means or spring 36.

Continuing, it will be observed the electrically insulating body member 32 is encircled or surrounded by a metallic shield or screen 44 which protrudes beyond the end face or surface 40 and has inwardly flanged or turned sections 45*a*, that alternate with axially extending lugs 45*b*. The lugs 45*b* project axially beyond the contact elements 42 so that, as the connector parts 2 and 4 are brought together, the shields or screens 18 and 44 come into contact before the individual contact pieces or elements of the respective connector parts are brought into contact, thus hindering false signals in this single connection phase of the electrical connector, so that there is afforded a positive contact with the shield or screen 18 of the connector part 4. Merging radially at the outside is a cap or closure member 46 which has a nose or protuberance 48 which engagingly coacts with the smaller groove 22 of the coupling portion 20 of the connector part 4 when the connector parts 2 and 4 are intercoupled with one another. This cap or closure member 46 is also provided with a further not here visible wider nose or protuberance which engagingly coacts with the wider groove 24 of the connector part 4 upon intercoupling the connector parts 2 and 4 with one another. The noses or protuberances 48 additionally engage with the recesses 26 of the coupling portion 20, and after pivoting the coupling portions 2 and 4, limit the pivot path and lockingly secure the coupled connector parts 2 and 4 in their correct mutual position, so that the contact pieces 16*a*, 16*b*, 16*c*, 16*d* and 16*e* of the connector part 4 are in proper contact-making or physical contact with the contact pieces 42 of the contact pins 34 of the connector part 2.

The cap or closure member 46 carries at its inner situated part 46*a* the housing or casing 30 which is provided with an electrical cable guide 50 at the end thereof facing away from the cap or closure member 46, in order to be able to introduce a suitable electrical cable (not shown) into the housing or casing 30 and to reliably secure the same therein.

Numerous other designs of the electrical connector are possible. Thus, for instance, the contact pieces 16*a*, 16*b*, 16*c*, 16*d* and 16*e* of the connector part 4 need not be only convex but can be formed at discreet regions to have raised portions, so that during the entire pivot motion a contact piece 42 of the one connector part 2 engages with the associated contact piece of the other connector part 4. Instead of using the bayonet closure or locking structure for the connector parts 2 and 4, there also can be provided loose retaining nuts or screw caps or the like and/or other appropriate fixation devices, in order to ensure for the exact alignment of the contact pieces 16*a*–16*e* of both connector parts 2 and 4. Instead of equipping each of the contact pins 34 with a spring 36, each contact pin 34 can be embedded by a suitable elastic material, generally indicated in FIG. 1 by reference numeral 62, in the electrically insulating body member 32, so that in this way there is ensured for a resilient pre-bias in the direction of the contact piece of the other connector part 4. According to a further advantageous construction, the cap or closure member 46 is not fixedly arranged, rather so as to be displaceable in axial direction upon a housing or casing part, so that it can be moved in order to facilitate access to the contacts 42, and thus, to afford a more effective and easier cleaning. In this regard, the cap member 46 can be guided in a groove or the like for safeguarding the same against torsion. Furthermore, it is possible to design the connector part 2 of FIG. 1 to be angled or flexed instead of straight as shown therein.

While there are shown and described present preferred embodiments of the invention, it is distinctly to be understood the invention is not limited thereto, but may be otherwise variously embodied and practiced within the scope of the following claims.

What is claimed is:

1. An electrical connector, especially for sensors, comprising:

a first connector part possessing at least two poles;

an electrically insulating body member provided for said first connector part;

shield means surrounding the electrically insulating body member of the first connector part;

a second connector part which can be coupled with the first connector part and possessing at least two poles;

an electrically insulating body member provided for said second connector part;

shield means surrounding the electrically insulating body member of the second connector part;

position-fixing means for fixing the mutual position of the first connector part and the second connector part when the first and second connector parts are intercoupled with one another;

each connector part having an end face;

each electrically insulating body member having an end face;

the end faces of the electrically insulating body members confronting one another when the first and second connector parts are intercoupled with one another;

the first and second connector parts, when intercoupled with one another, defining a plug-in axis extending lengthwise of the first and second connector parts;

the end faces of the electrically insulating body members defining surfaces disposed substantially perpendicular to the plug-in axis;

a contact piece for each pole of the second connector part provided at the end face of the second connector part;

one of the connector parts defining a plug part;

the other one of the connector parts defining a socket part;

the contact pieces of the one connector part defining the plug part being stationarily arranged;

means for resiliently mounting each contact piece of one of the connector parts in a predetermined direction defining a contact-making direction of each contact piece of the one connector part;

each contact piece of the other connector part being disposed at least approximately in a plane containing the end face of the other connector part;

the shield means of the one connector part defining the plug part surrounding the electrically insulating body member and extending to a position which is substantially flush with the end face of such electrically insulating body member;

the shield means of the other connector part defining the socket part extending beyond the end face of the electrically insulating body member beyond the end face of the electrically insulating body member of the other connector part; and bayonet fixing means for enabling the first and second connector parts, when intercoupled with one another, to pivot from a predetermined plug-in position to a predetermined contact position.

2. The electrical connector as defined in claim 1, wherein:

each contact piece of one connector part has an end face which possesses a substantially convex shape and each contact piece of the other connector part has an end face which possesses a substantially planar shape.

3. The electrical connector as defined in claim 1, wherein:

each contact piece of each connector part has an end face which possesses a substantially convex shape.

4. The electrical connector as defined in claim 1, wherein:

the resiliently mounting means for each contact piece of one of the connector parts comprise an elastic material.

5. The electrical connector as defined in claim 1, wherein:

the resiliently mounting means for each contact piece of one of the connector parts comprise spring means for resiliently pre-biasing each contact piece.

6. The electrical connector as defined in claim 1, further including:

sensor means; and one of the connector parts defining a plug part which is fixedly connected with the sensor means.

7. A multi-pole electrical connector, comprising:

a first connector part;

an electrically insulating body member provided for said first connector part;

shield means surrounding the electrically insulating body member of the first connector part;

a second connector part which can be coupled with the first connector part;

an electrically insulating body member provided for said second connector part;

shield means surrounding the electrically insulating body member of the second connector part;

position-fixing means for fixing the mutual position of the first connector part and the second connector part when the first and second connector parts are intercoupled with one another;

each connector part having an end face;

each electrically insulating body member having an end face;

the end faces of the electrically insulating body members confronting one another when the first and second connector parts are intercoupled with one another;

the first and second connector parts, when intercoupled with one another, defining a plug-in axis extending lengthwise of the first and second connector parts;

the end faces of the electrically insulating body members defining surfaces disposed substantially perpendicular to the plug-in axis;

a contact piece for each pole of the second connector part located at the region of the end face of the second connector part;

one of the connector parts defining a plug part;

the other one of the connector parts defining a socket part;

the contact pieces of the one connector part defining the plug part being stationarily arranged;

means for resiliently biasing each contact piece of one of the connector parts in a predetermined direction defining a contact-making direction of each contact piece of the one connector part; and each contact piece of the other connector part being disposed at least approximately in a plane containing the end face of the other connector part;

the shield means of the one connector part defining the plug part surrounding the electrically insulating body member and extending to a position which is substantially flush with the end face of such electrically insulating body member;

the shield means of the other connector part defining the socket part extending beyond the end face of the electrically insulating body member beyond the end face of the electrically insulating body member of the other connector part; and bayonet fixing means for enabling the first and second connector parts, when intercoupled with one another, to pivot from a predetermined plug-in position to a predetermined contact position.

* * * * *